United States Patent [19]

Lambel et al.

[11] 4,059,858

[45] Nov. 29, 1977

[54] DRAIN CLEANER PROVIDING SUDDEN BLAST OF GAS

[76] Inventors: Reinhold Lambel, 517 E. Algonquin Road, Arlington Heights, Ill. 60005; Steven Maynard, 716 Webley Court, Schaumburg, Ill. 60671

[21] Appl. No.: 635,344

[22] Filed: Nov. 26, 1975

[51] Int. Cl.[2] ..... B08B 9/02; B08B 5/00

[52] U.S. Cl. ..... 4/255; 15/406; 134/166 C; 137/68 R

[58] Field of Search ..... 137/68 R, 69, 71, 240; 15/406; 4/255; 220/89 A; 134/166 C, 167 C, 168 C, 169 C

[56] References Cited

U.S. PATENT DOCUMENTS

| | | | |
|---|---|---|---|
| 1,393,548 | 10/1921 | Koudelka | 15/406 X |
| 1,769,061 | 7/1930 | Hitchcock | 4/255 X |
| 2,553,267 | 5/1951 | Nedoh | 137/68 R X |
| 2,656,950 | 10/1953 | Coffman | 220/89 A |
| 3,195,769 | 7/1965 | Miller | 220/89 A |
| 3,426,774 | 2/1969 | Conn | 137/240 X |

*Primary Examiner*—Martin P. Schwadron
*Assistant Examiner*—Richard Gerard
*Attorney, Agent, or Firm*—Darbo & Vandenburgh

[57] ABSTRACT

Apparatus for clearing drain lines includes an appliance which may be held in sealed engagement over a drain opening and actuated with a sudden burst of gas pressure. The appliance includes a pressure chamber which can discharge into a sealing ring and which for each operation is initially closed off from the sealing ring by a rupturable metal diaphragm. While the appliance is held by hand with its pressure ring firmly sealed around the drain opening, gas pressure is increased in the pressure chamber until the diaphragm suddenly ruptures to release the compressed gas into the drain with a sudden hammer-like action. The gas pressure may be supplied from a pressure can or by pump. This metal diaphragm may be a conventional jar-cap as used for home canning, except accurately scored to rupture at a predetermined pressure.

2 Claims, 3 Drawing Figures

DRAIN CLEANER PROVIDING SUDDEN BLAST OF GAS

The invention of which the present disclosure is offered for public dissemination in the event adequate patent protection is available relates to the clearing of drains, of which the drains from a kitchen sink or the bowl of a water closet (toilet) are typical examples.

There have of course been many devices and chemicals for clearing drains. There are objections to chemicals, including personal and ecological dangers. Pressure has been used at least as long as the "plumber's helper" has been known. More recently, there has been extensive promotion of relatively sophisticated apparatus for developing pressure more easily or more effectively than most users could achieve with such manual plunger devices as the old "plunger's helper". A sudden jolt of pressure is deemed to be best. Heretofore, such apparatus for providing its own sudden jolt has been, at least in its more effective versions, relatively expensive and more suitable for ownership by a plumber than for wide-scale sales to homeowners. Versions available at low cost have been quite limited as to number of "shots" and are believed to have been relatively sluggish in the delivery of the gas jolt.

The present invention is intended to make, in a low-cost form suitable for sales to individual homeowners, effective equipment for suddenly releasing a gas of predetermined quantity and pressure. The low cost is achieved by the utmost simplicity, especially of parts which are not readily available market items, such as a tire pump or a small can of liquefied gas. The automatic release of a predetermined quantity of gas at a predetermined pressure is achieved by using a sheet metal diaphragm which is scored or die-impressed to leave only a predetermined reduced thickness of metal which must be ruptured. Hence without the cost of a pressure gauge, and without any triggering mechanism, the gas will burst forth at a given pressure so that, assuming the device has been held in a sealed position over a drain, this predetermined pressure and quantity of gas will be directed at the clogged drain. The diaphragms, except for the die-impression of the present invention, are standard jar lids made by the millions and hence available at very low cost.

The advantages of the invention will be more apparent from the following description and from the drawings.

BACKGROUND DESCRIPTION

Figure 1:
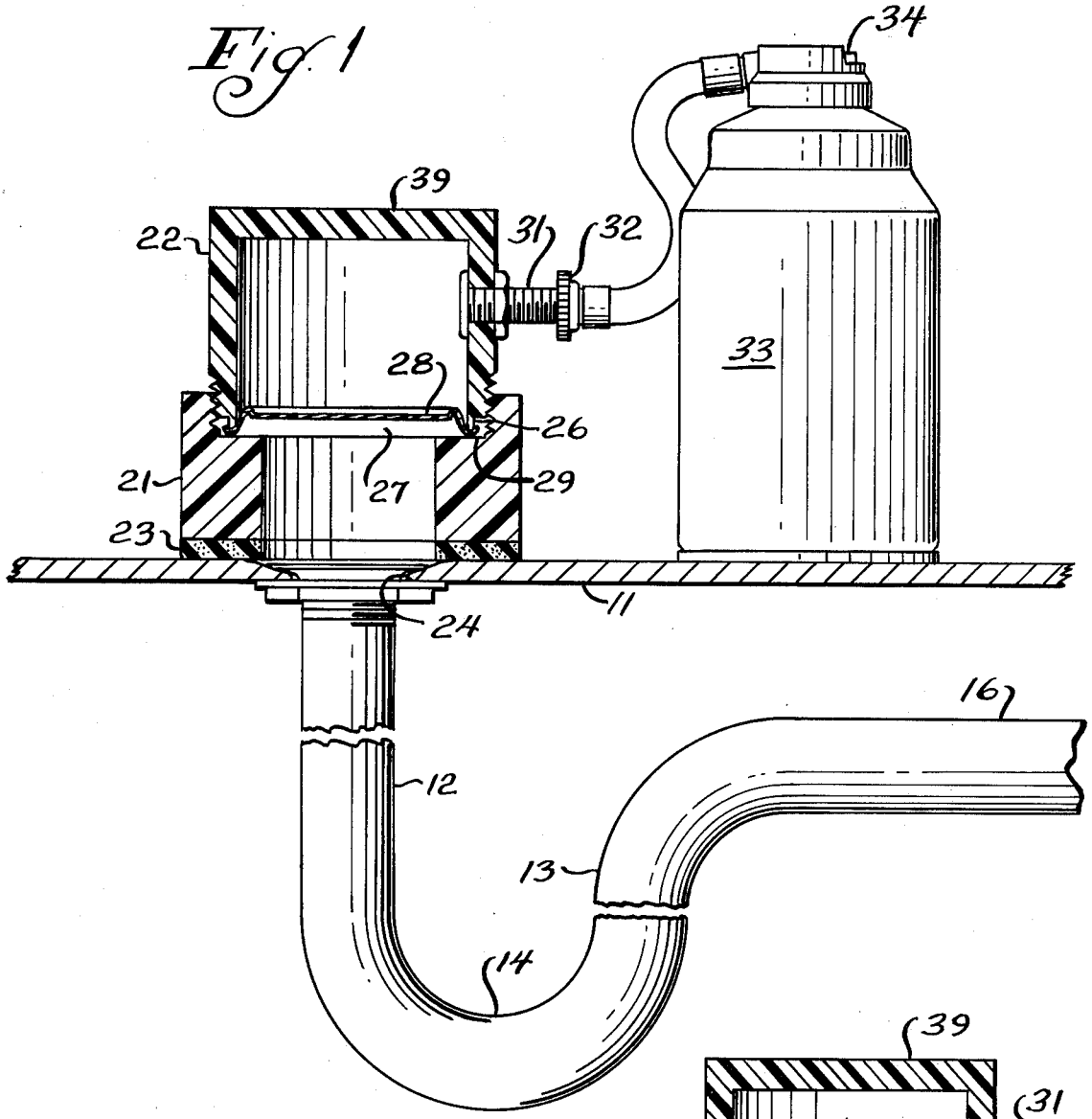
FIG. 1 is a view showing the main apparatus of the present invention in vertical cross section, as applied to clearing a kitchen sink drain.

The drains to be cleaned are usually provided with a downward "U" bend or other type of trap for providing a water seal. Thus in the illustrated type of drain for a kitchen sink 11, the drain pipe 12 extends downwardly and then curves upwardly at 13 to form a trap 14. The drain pipe curves again to extend at 16 downwardly or horizontally. If it extends horizontally, it communicates with a downwardly extending drain such as a soil pipe.

Usually, in kitchen sinks, the trap 14 can be removed, although the joints needed for removal have been omitted from the drawings for simplicity. The clogging material is quite often in the trap 14 and needs to be dislodged from that trap. When that is not the case, there is usually water in the trap 14 which, when pressure is suddenly properly applied, can serve as a water-hammer (in a sense different from the usual) to jar loose the clogging material at a more downstream location.

THE PRESENT INVENTION

The present invention preferably includes a seal ring 21 and a pressure chamber 22, both formed of sturdy plastic material. The seal ring 21 may be provided with a flat gasket 23 of resiliently compressible material such as foam rubber, for sealing around a drain opening 24 in a sink, wash stand, or the like. Alternatively, the seal ring 21 may be provided with a more specially shaped connector to be wedged into the drain opening of the drain to be cleared. For clearing the drain from a water closet bowl, a relatively large diameter sleeve carrying a wedge or conically shaped resilient seal sleeve should be provided to seal in the exit mouth of the bowl.

Figure 2:
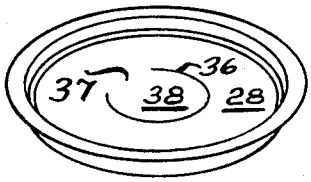
FIG. 2 is a perspective type of view of the die-impressed cap in FIG. 1.

The pressure chamber 22 is preferably secured to the seal ring 21 either by threaded connection as shown or by a bayonet type of engagement in which a quarter turn or so may achieve the desired tightening. In either event, the pressure chamber 22 is preferably provided with a lip 26 which engages in a peripheral seal rim 27 of a modified jar lid 28, scored as seen in FIG. 2. The pressure of the threads or other camming surfaces seals the lip 26 to the rim 27 and also seals the lid 28 to surface 29 of the sealing ring 21. The seal of the lip 26 on the peripheral rim 27 is usually extremely airtight, inasmuch as the surface of the peripheral lip 27 which is engaged by the rim 26 is conventionally coated with a gasket material for perfecting the seal against a jar rim.

The pressure chamber 22 is preferably provided with a connector fitting, such as stem 31, which may be outwardly identical with the valve stem of a tire. A female connector 32 threads onto the connector 31 and may be connected with any suitable source of pressure. This source of pressure could be a bicycle pump, but has been illustrated as a can 33 of liquefied or highly compressed gas. These cannisters are readily available at low cost and hold enough gas for many charges of the pressure chamber 22.

OPERATION

After applying a fresh scored lid 28 to the pressure chamber 22 and threading the pressure ring 21 onto it, the connector 32 of the pressure source is screwed firmly on the connector 31 to provide the total apparatus illustrated in FIG. 1. The device is then placed over the drain to be cleared as seen in FIG. 1 and held firmly pressed down thereon with one hand. The other hand (or the same hand when necessary) operates the button 34 of the pressure can 33 to discharge the gas under pressure into the pressure chamber 22. If a pump is used, it will usually be operated by a helper. It should be a valved pump (to prevent return of air into the pumping chamber once it has been forced out) because preferably there it no valve in the stem 31. it is preferred that if the operation should be terminated before completion any loosening of the connection 32 will permit the gas to escape harmlessly from the chamber 22.

Figure 3:
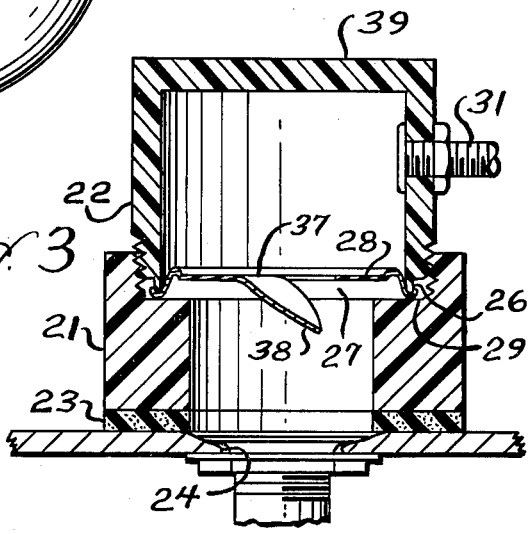
FIG. 3 is a fragmentary view corresponding to FIG. 1, showing the diaphragm after it has ruptured.

Ordinarily the supply of gas to the chamber 22 will be continued until, all of a sudden, the diaphragm 28 bursts. Its burst condition is shown in FIG. 3. This allows the entire volume of gas, which has been accumulating in the pressure chamber 22 until the bursting pressure was reached, to discharge suddenly into the drain 12. This will usually clear the stoppage. a water closet bowl, a relatively large diameter sWhen it does not on the first try, a fresh modified lid 28 may be substituted for the used lid 28 and the operation repeated.

As seen in FIG. 2, the lid 28 is preferably modified by forming a die impression 36 therein of "U" or horse-shoe shape, and of a diameter large enough so that when it ruptures the entire accumulation of gas from the pressure chamber 22 will almost instantly discharge through the sealing ring 21. The horse-shoe shape of the die impression (line 36) is preferred so that a web of metal 37 will not be ruptured but will form a connecting web for holding the displaced tongue 38 to the lid 28. Thus, if the button 34 should be pressed when the device is not in position, there will be no flying piece of metal or "shrapnel".

The die impression or score line 36 is formed by a punch press provided with limiting blocks which determine the thickness of the metal left by the impression 36. A thickness which yields at approximately 60 pounds per square inch of pressure is at present preferred. The term "score" is used in a broad sense, not requiring a scraping tool.

ADDITIONAL OPTIONAL SAFETY FEATURE

Safety considerations may dictate that some safety feature be provided to guard against the possibility that some user will erroneously insert an unmodified jar lid 28 instead of the die-impressed jar lid of FIG. 2. To this end, the pressure chamber 22 may be fitted with a pressure relief valve to yield at a pressure of about 5 or 10 pounds higher than the intended pressure (and well below the test-strength of the plastic), though for simplification of illustration no such valve has been illustrated. Preferably such valve if provided should extend from a side wall so that the top 39 of the pressure chamber 22 will be unobstructed for application of manual pressure.

FURTHER DETAILS

In wash bowls, and other instances where an overflow opening for a bowl communicates with the clogged drain, or when for any other reason there is an opening through which the sudden surge of gas could escape without doing its work, it is desirable to hold a cloth firmly over such opening, substantially sealing it. Preferably the can 33 will be low enough so that the operator can operate it with a finger or thumb of the hand which is pressing down on the top 39, so that the operator's other hand may be used for holding the cloth across the overflow opening. Also, can 33 can be small enough to be held in the hand while the heel of the same hand is pressing down top 39.

A score or die found to be satisfactory for scoring the lid or diaphragm has a 60° taper (30° on each side) to a narrow flat entry face (a nearly sharp edge) of about 0.001 to 0.002 inch width. A diaphragm that bursts at nearly the desired pressure of 60 pounds per square inch results from a penetration or scoring of all but 0.002 inch through the thickness of the lid, with a diameter across the arc of the score line of about $\frac{7}{8}$ inch. After setting the punch press stops, scored pieces should be tested and the stop thickness adjusted until the desired bursting pressure is sufficiently approximated.

When a gas-cannister is used, its fill may be liquid Freon or $CO_2$, for example, either one being capable of giving many operations before being depleted.

It has been found that a seal gasket or fitting of nearly universal use is provided by a hemisphere of 4.5 inch diameter with a 1.75 inch diameter passage through it. It fits most waterclosets, sinks, tubs and wash bowls.

In a satisfactorily tested embodiment of the invention sealing ring 21 and pressure chamber 22 were formed of polyproplene. Nylon and Delrin are also believed to be highly suitable.

An optional method of use is to partly fill the pressure chamber with water before applying diaphragm 28. With the device held in the position shown, the water above tongue 38 will be shot into the drain when the diaphragm bursts. If this use were to be the recommended use, the pressure chamber 22 would probably be made of larger internal volume, and changes might be made to ensure better flow through the ruptured diaphragm. Another method of operation is to run water toward the clogged drain until there is a pool above the drain opening into which the device can be immersed. If the ring 21 is temporarily loosened during the immersing movement, water can be allowed to flow into it to help transmit the thrust of the gas, when the diaphragm ruptures, to the clogged zone.

The 60 pounds pressure mentioned is subject to wide variation at the preference of the user or seller. Diaphragms scored and marked for different rupture strengths could be provided, and 40 pound diaphragms used except where this pressure proved inadequate. The lower pressure is economical in that it uses less gas per charge. It also causes less backwards kick so that holding it to resist the kick is easier.

ACHIEVEMENT

From the foregoing it is seen that a drain clearing apparatus is provided which can be sold at a low cost suitable for a home owner, but which can be used many times at very low cost per "shot" to clear a drain with a very sudden jolt of gas pressure.

INTENT CLAUSE

Although the disclosure offered for public dissemination is detailed to ensure adequacy and aid understanding, this is not intended to prejudice that purpose of a patent which is to cover each new inventive concept therein no matter how others may later disguise it by variations in form or additions or further improvements. The claims at the end hereof are intended as the chief aid toward this purpose, as it is these that meet the requirement of pointing out the parts, improvements, or combinations in which the inventive concepts are found.

We claim:

1. Apparatus for clearing clogged drains including a sealing ring for sealing around the drain opening, a pressure chamber arranged for delivering through said seal ring and opening a sudden burst of fluid under gas pressure; a rupturable diaphragm initially sealing the pressure chamber from said ring but constructed to open suddenly for copious flow in response to a high pressure in the pressure chamber, and means for supplying gas under pressure to the pressure chamber to raise the pressure therein until said high pressure is reached;

in which the diaphragm is constructed with a scoredemarked tongue, the scoring leaving a web which retains connection of the tongue to the diaphragm when rupture separates other tongue edges.

2. Apparatus for clearing a clogged drainpipe including a seal ring for sealing around the drain opening, a pressure chamber arranged for delivering through said seal ring and opening and along said pipe a sudden bursting flow of fluid under gas pressure; a rupturable diaphragm initially sealing the pressure chamber from said ring but constructed to open suddenly for copious flow in response to a high pressure in the pressure chamber, and means for supplying gas under pressure to the pressure chamber to raise the pressure therein until said high pressure is reached, characterized in that:

the diaphragm is constructed of metal with a score-demarked tongue to provide an opening comparable in size to the drain opening which the seal ring is adapted to seal, thus permitting the passage of a forceful stream, comparable in cross section to such drain opening, moving along said pipe.

* * * * *

UNITED STATES PATENT AND TRADEMARK OFFICE

CERTIFICATE OF CORRECTION

PATENT NO. : 4,059,858

DATED : November 29, 1977

INVENTOR(S) : Reinhold Lambel and Steven Maynard

It is certified that error appears in the above-identified patent and that said Letters Patent are hereby corrected as shown below:

| | |
|---|---|
| Col. 1, l. 18 | "plunger's helper" should be --"plumber's helper"-- |
| Col. 1, l. 38 | insert a comma (,) after "Hence" |
| Col. 2, l. 63 | "it" first occurrence should be --is-- |
| Col. 2, l. 63 | "it" second occurrence, should be --It-- |
| Col. 3, ls. 5,6 | delete "a water closet bowl, a relatively large diameter s" |
| Col. 4, l. 57 | "sealing", first occurrence, should be --seal-- |

Signed and Sealed this

*Seventh* Day of *March 1978*

[SEAL]

*Attest:*

RUTH C. MASON
*Attesting Officer*

LUTRELLE F. PARKER
*Acting Commissioner of Patents and Trademarks*